United States Patent [19]

Kitamura

[11] Patent Number: 4,809,841

[45] Date of Patent: Mar. 7, 1989

[54] APPARATUS FOR DRIVING A PASSENGER CONVEYOR

[75] Inventor: Shigeharu Kitamura, Inazawa, Japan

[73] Assignee: Mitsubishi Denki Kabushiki Kaisha, Japan

[21] Appl. No.: 855,394

[22] Filed: Apr. 24, 1986

[30] Foreign Application Priority Data

Apr. 26, 1985 [JP] Japan ..... 60-90514
Apr. 26, 1985 [JP] Japan ..... 60-90515

[51] Int. Cl.[4] ..... B66B 23/02

[52] U.S. Cl. ..... 198/330; 198/855; 474/31

[58] Field of Search ..... 198/330, 854–857; 474/29, 31

[56] References Cited

U.S. PATENT DOCUMENTS

| | | | |
|---|---|---|---|
| 2,005,067 | 6/1935 | Graff-Baker | 198/330 |
| 2,198,179 | 4/1940 | Regan | 474/31 X |
| 2,395,599 | 2/1946 | Webb et al. | 474/31 X |
| 2,476,353 | 7/1949 | Booth | 474/31 |
| 2,949,178 | 8/1960 | Fabula | 198/330 X |
| 3,035,453 | 5/1962 | Ingellis | 474/31 |
| 3,490,301 | 1/1970 | Steuer | 474/31 X |
| 3,731,549 | 5/1973 | Kaiser et al. | 474/31 X |
| 3,916,705 | 11/1975 | Smith et al. | 474/31 |
| 4,116,080 | 9/1978 | Berens | 474/31 X |
| 4,631,467 | 12/1986 | Herrmann et al. | 198/330 X |

FOREIGN PATENT DOCUMENTS

| | | | |
|---|---|---|---|
| 0101581 | 8/1980 | Japan . | |
| 0047786 | 3/1983 | Japan . | |
| 1030290 | 7/1983 | U.S.S.R. | 198/330 |
| 1089029 | 4/1984 | U.S.S.R. | 198/330 |

OTHER PUBLICATIONS

"CVT Belt Turbo Trac" 59-18415.

*Primary Examiner*—Robert J. Spar
*Assistant Examiner*—Lyle Kimms
*Attorney, Agent, or Firm*—Leydig, Voit & Mayer

[57] ABSTRACT

An apparatus for driving a passenger conveyor including a plurality of steps connected to each other by a step chain for moving the steps comprises a motor, a reduction gear driven by the motor, a chain gearing device, driven by the reduction gear, for driving the step chain, and a stepless change gear for connecting the rotary output shaft of the motor to an input shaft of the reduction gear. The stepless change gear steplessly changes the relative rotational speeds of the motor and the reduction gear.

15 Claims, 6 Drawing Sheets

APPARATUS FOR DRIVING A PASSENGER CONVEYOR

BACKGROUND OF THE INVENTION

The present invention relates to an apparatus for driving a passenger conveyor in which the operational speed of the passenger conveyor is variable.

A conventional apparatus for driving a passenger conveyor mainly comprises an electric motor, a reduction gear for reducing the rotational speed of the motor to a speed suitable for conveying passengers, and a chain gearing device rotated by the reduction gear to drive a step chain connecting a plurality of steps to each other. The driving apparatus further comprises a means for operating the passenger conveyor at a low speed to variously adjust the passenger conveyor during installation and maintenance thereof.

Such a conventional passenger conveyor provided with the means for operating the conveyor at a low speed is disclosed in Japanese Laid-Open Patent No. 55-101581 for example.

In the passenger conveyor driving apparatus of this type, a drive unit for operating the passenger conveyor at a low speed (6 m/min) is disposed in addition to a main drive unit for operating the passenger conveyor at a normal speed (30 m/min or 40 m/min). The passenger conveyor can be operated using the drive unit for low speed operation during installation and maintenance of the passenger conveyor.

In the conventional passenger conveyor mentioned above, not only is it necessary to have a separate drive unit for low speed operation in addition to the main drive machine, it is also necessary to have a transmission device such as an electromagnetic clutch for enabling the drive unit for low speed operation to be connected or disconnected with the reduction gear, thereby increasing the cost of the passenger conveyor driving apparatus while requiring extra space in the machine room in which the drive units etc. are disposed.

Furthermore, in this kind of passenger conveyor, although it is convenient to install and maintain the drive unit for low speed operation, the operational speed of the passenger conveyor cannot be controlled since the speed is constantly fixed at a safe speed such as 6 m/min. Accordingly, it cannot be adjusted to the various operational speeds needed for the operations during installation and maintenance of the passenger conveyor, thereby reducing the efficiency of such operations.

Another conventional apparatus for driving a passenger conveyor is disclosed in Japanese Laid-Open Patent No. 58-47786 for example and is illustrated in FIGS. 1 and 2. A machine room 2 is disposed at the upper end of a main frame 1 of the passenger conveyor. An upper chain gearing device 3 in the vicinity of the machine room 2 and a lower chain gearing device 4 are respectively attached to the upper and lower ends of the main frame 1. A step chain 5 is endlessly wound around the upper and lower chain gearing devices 3 and 4 to endlessly connect a plurality of steps 6 to each other. A drive unit 7 disposed within the machine room 2 comprises an electric motor 8 and a reduction gear 9. The rotary shaft 8*a* of the electric motor 8 is connected to an input shaft 9*a* of the reduction gear 9 through a transmission mechanism 10. A drive sprocket 11 connected to an output shaft 9*b* of the reduction gear 9 is connected to a driven sprocket 3*a* of the upper chain gearing device 3 through a chain 12 to transmit the rotation of the reduction gear 9 to the upper chain gearing device 3, thereby driving the step chain 5 for moving the steps 6.

The operational speed of the drive unit 7 is constant in general and increases and decreases in the operational speed thereof are determined by the starting torque of the electric motor and the inertia of the system.

Recently, a passenger conveyor in which the operational speed thereof can be switched in two stages has been recently used.

In such a passenger conveyor, the operational speed of a drive unit is changed by switching the number of poles of the electric motor. For example, the number of poles is set to be six at an operational speed of 40 m/min and eight at an operational speed of 30 m/min.

In the drive apparatus in which the operational speed of the passenger conveyor is constantly fixed, although a slow increase or decrease of the operational speed of the passenger conveyor can be performed by disposing a large-sized fly-wheel etc., but this requires that the brake and other devices be made larger and it also makes it difficult to arbitrarily change the operational speed of the passenger conveyor.

In a passenger conveyor in which the operational speed thereof is switched in two stages, when the operational speed is to be changed, the operation of the passenger conveyor must be stopped once and then restarted after the number of poles of the electric motor has been switched to a suitable number of poles. This stopping of the conveyor is inconvenient to the passengers and the consumption of electric power from restarting is large. Further, since the motor is made larger to accommodate the increase in the number of poles of the electric motor, the electric motor cannot be disposed within the main frame in some cases.

SUMMARY OF THE INVENTION

To overcome the conventional problems mentioned above, an object of the present invention is to provide an apparatus for driving a passenger conveyor in which the operational speed of the passenger conveyor can be arbitrarily set and a means for adjusting the operational speed of the passenger conveyor can be cheaply constituted.

Another object of the present invention is to provide an apparatus for driving a passenger conveyor in which slow starting, slow stoppage and slow speed change of the passenger conveyor can be controlled by a stepless change gear and in which the driving apparatus is compact.

With the above objects in view, the present invention resides in an apparatus for driving a passenger conveyor including a plurality of steps connected to each other by a step chain for moving the steps, said apparatus comprising a motor, a reduction gear driven by the motor, a chain gearing device, driven by the reduction gear, for driving the step chain, and a stepless change gear for connecting the rotary shaft of the motor to an input shaft of the reduction gear, said stepless change gear steplessly changing the relative rotational speeds of the motor and the reduction gear.

BRIEF DESCRIPTION OF THE DRAWINGS

The present invention will be now described with reference to the preferred embodiments thereof in conjunction with the drawings in which.

DETAILED DESCRIPTION OF THE PREFERRED EMBODIMENTS

Figure 1:
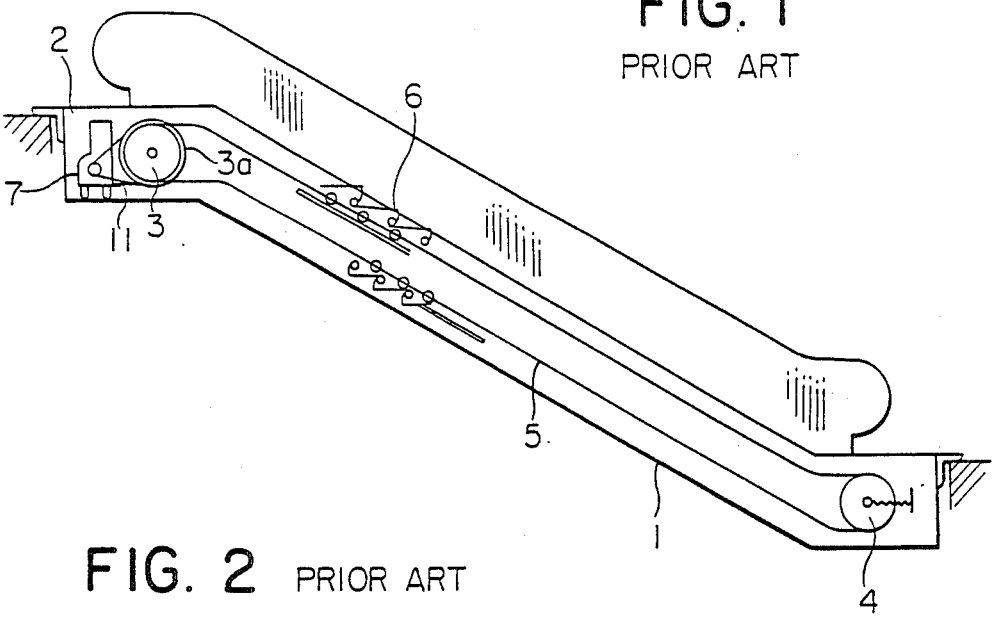
FIG. 1 PRIOR ART
FIG. 1 is a schematic side sectional view of a conventional passenger conveyor.
Figure 2:
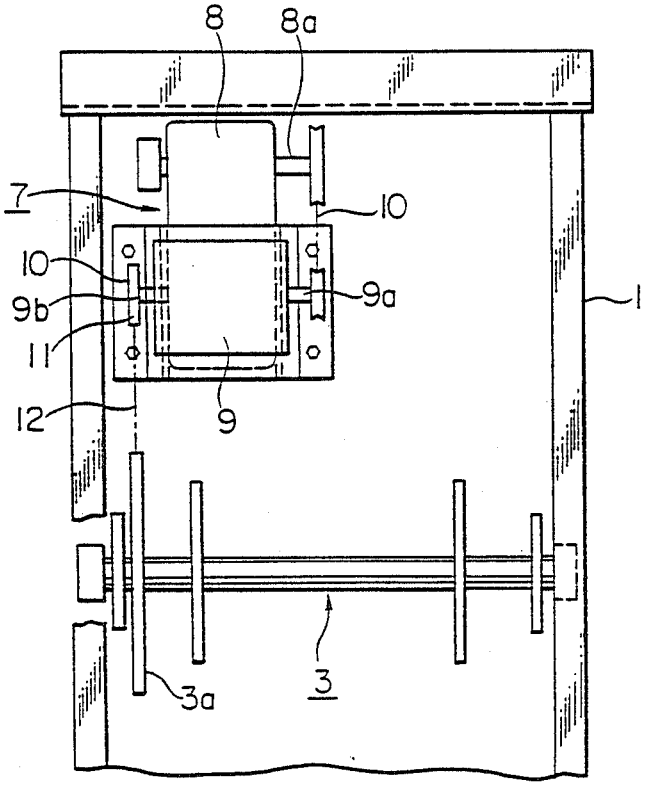
FIG. 2 PRIOR ART
FIG. 2 is a plan view of a conventional apparatus for driving the passenger conveyor of FIG. 1.
Figure 3:
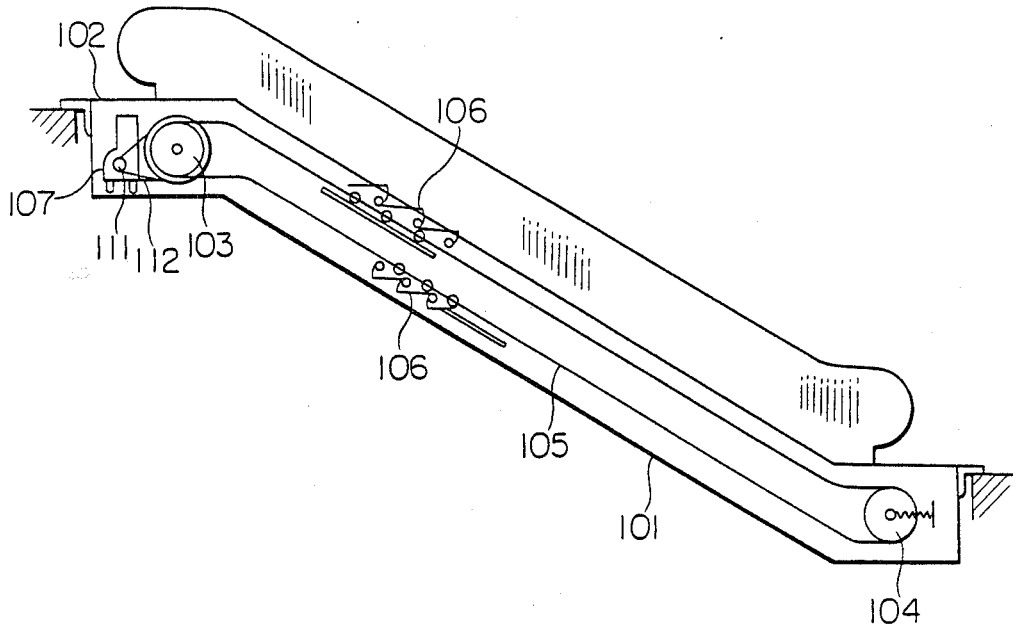
FIG. 3 is a schematic side sectional view of a passenger conveyor having an apparatus for driving the passenger conveyor according to a first embodiment of the present invention.
Figure 5:
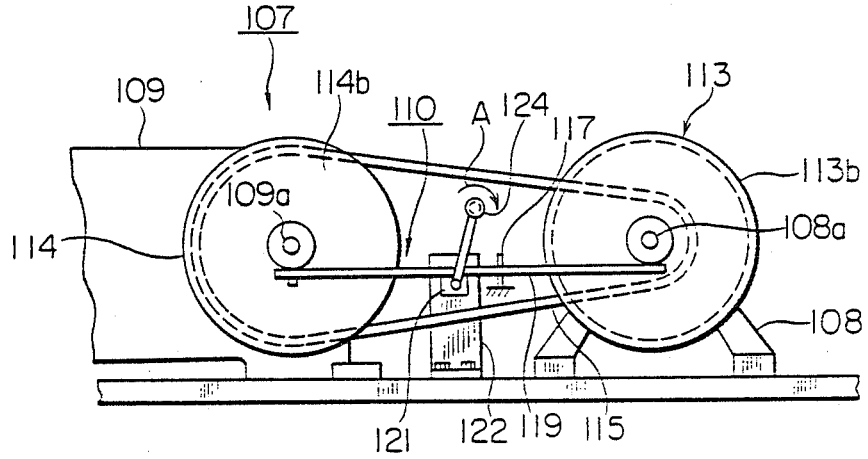
FIG. 5 is a side view of the apparatus for driving the passenger conveyor taken along Line V—V of FIG. 4.
Figure 4:
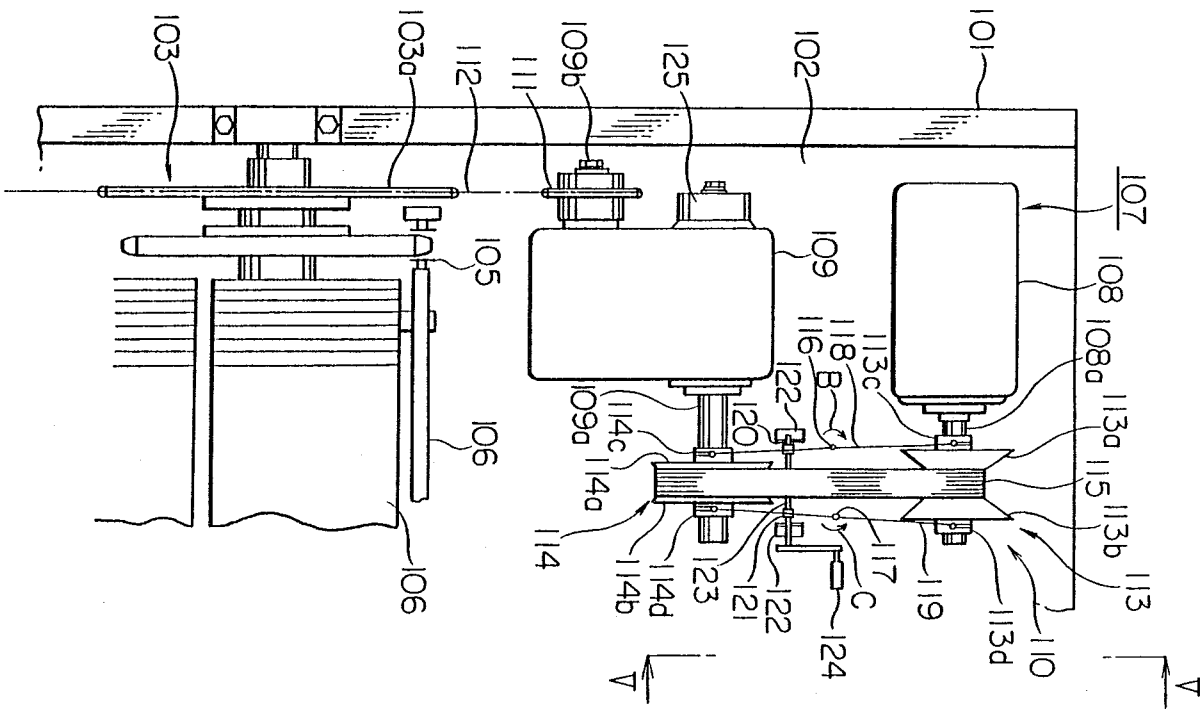
FIG. 4 is an enlarged plan view of the apparatus for driving the passenger conveyor of FIG. 3.

In FIGS. 3 to 5, a machine room 102 is disposed in the upper end of a main frame 101 of the passenger conveyor. An upper chain gearing device 103 in the vicinity of the machine room 102 and a lower chain gearing device 104 are respectively attached to the upper and lower ends of the main frame 101. A step chain 105 is endlessly wound around the upper and lower chain gearing devices 103 and 104, and a plurality of steps 106 are endlessly connected to each other by the step chain 105. A drive unit 107 disposed within the machine room 102 comprises an electric motor 108 and a reduction gear 109. The rotary input shaft 108*a* of the electric motor 108 is connected to a rotary input shaft 109*a* of the reduction gear 109 through a belt driven type stepless change gear 110 in which the rotation of the electric motor 108 is transmitted to the reduction gear 109 while steplessly changing their relative rotational speeds as described later. A drive sprocket 111 connected to an output shaft 109*b* of the reduction gear 109 is connected to a driven sprocket 103*a* of the upper chain gearing device 103 through a chain 112 to transmit the rotation of the reduction gear 109 to the upper chain gearing device 103, thereby driving the step chain 105 and the steps 106.

As shown in FIGS. 4 and 5, the stepless change gear 110 has a pair of V-shaped pulleys 113 and 114 variable in the effective diameters thereof and respectively attached to the rotary shaft 108*a* of the electric motor 108 and the input shaft 109*a* of the reduction gear 109. The pulleys 113 and 114 respectively comprise pairs of circular truncated conical members 113*a*, 113*b* and 114*a*, 114*b* which are axially slidably attached to the rotary shaft 108*a* of the electric motor 108 and the input shaft 109*a* of the reduction gear 109. The pair of circular truncated conical members 113*a* and 113*b* are opposite each other and form a generally V-shaped groove therebetween with which an endless V-belt 115 is engaged. The pair of circular truncated conical members 114*a* and 114*b* are opposite each other and form a generally V-shaped groove therebetween with which an endless V-belt 115 is engaged. The belt 115 is wound around the pulleys 113 and 114 for transmitting the rotation of the electric motor 108 to the reduction gear 109.

The circular truncated conical members 113*a*, 113*b* and 114*a*, 114*b* respectively have bosses 113*c*, 113*d* and 114*c*, 114*d* on the outsides thereof. The bosses 113*c* and 113*d* are respectively connected to the bosses 114*c* and 114*d* through first and second links 118 and 119 which are pivotally mounted on pivot shafts 116 and 117 secured to the main frame of the passenger conveyor. The first and second links 118 and 119 are respectively located between the bosses 113*c* and 113*d* and between the bosses 114*c* and 114*d*. The first and second links 118 and 119 are relatively rotatably connected to the respective bosses 113*c*, 114*c* and 113*d*, 114*d* at the ends thereof. A pair of ball nuts 120 and 121 are respectively secured to the links 118 and 119 and are opposite each other. The ball nuts 120 and 121 are screwed onto a feed screw 123 supported by brackets 122 at both ends thereof. The screw portions of the feed screw 123 engaged with the ball nuts 120 and 121 are formed such that the ball nuts 120 and 121 can be separated from or closed up upon each other by rotating the feed screw 123 respectively in the clockwise direction of arrow A of FIG. 5 or the counterclockwise direction opposite the arrow A. A handle 124 for rotating the feed screw 123 is attached to one end of the feed screw 123 to relatively increase or decrease the effective diameters of the V-pulleys 113 and 114 as described later. An electromagnetic brake 125 is disposed on the side opposite the input shaft 109*a* of the reduction gear 109.

In the apparatus for driving a passenger conveyor constructed as above, when the handle 124 is rotated in the direction of arrow A of FIG. 5, the feed screw 123 is rotated in the same direction and the ball nuts 120 and 121 engaged therewith are gradually separated from each other and rotate the links 118 and 119 around the pivot shafts 116 and 117 respectively in the clockwise and counterclockwise directions of arrows B and C of FIG. 4. Accordingly, the circular truncated conical members 113*a* and 113*b* of the electric motor 108 gradually approach each other along the rotary shaft 108*a* thereof, and the circular truncated conical members 114*a* and 114*b* of the reduction gear 109 are gradually separated from each other along the input shaft 109*a* thereof. Thus, the effective diameter of the V-pulley 113 of the electric motor 108 increases and the effective diameter of the V-pulley 114 of the reduction gear 109 decreases. Accordingly, the rotational speed of the reduction gear 109 is steplessly increased in accordance with the speed change ratio set by the ratio of the effective diameters of the V-pulleys 113 and 114.

When the handle 124 is rotated in the direction opposite arrow A of FIG. 5, the ball nuts 118 and 119 gradually approach each other to respectively rotate the first and second links 118 and 119 around the pivot shafts 116 and 117 in the directions opposite the arrows B and C of FIG. 4. Accordingly, the circular truncated conical members 113*a* and 113*b* of the pulley 113 are gradually separated from each other along the rotary shaft 108*a* of the electric motor 108, and the circular truncated conical members 114*a* and 114*b* of the pulley 114 gradually approach each other along the input shaft 109*a* of the reduction gear 109. Thus, the effective diameter of the pulley 113 of the electric motor 108 decreases and the effective diameter of the pulley 114 of the reduction gear 109 increases. This state is shown in FIG. 4 and the rotational speed of the reduction gear 109 is steplessly decreased.

Accordingly, when the passenger conveyor is operated at low speeds for adjusting the passenger conveyor during installation or maintenance thereof, as shown in FIG. 4, the speed change ratio is set such that the effective diameters of the V-pulleys 113 and 114 of the electric motor 108 and the reduction gear 109 are respectively decreased and increased, thereby adjusting the operational speed of the passenger conveyor to a speed suitable for installation and maintenance operations such as 6 m/min. Thus, the operational efficiency in adjusting the conveyor during installation or maintenance is improved and it is unnecessary to dispose a drive unit for low speed operation in addition to a main drive unit as in the conventional apparatus, thereby reducing the cost of the drive apparatus.

In contrast to the above case, when the operational speed of the passenger conveyor is set to be a normal speed such as 30 m/min or 40 m/min, the effective diameters of the V-pulleys 113 and 114 of the electric motor 108 and the reduction gear 109 are respectively increased and decreased, thereby setting the ratio of the effective diameters at the normal operational speed of the conveyor.

The structure of the V-pulleys 113 and 114 in the stepless change gear 110 is not limited to that shown in this embodiment, but other known structures may be used.

As mentioned above, according to the first embodiment in which a rotary shaft of a motor is connected to an input shaft of a reduction gear through a stepless change gear to steplessly and relatively change the rotational speeds of the motor and the reduction gear, the operational speed of the passenger conveyor can be arbitrarily set in accordance with various requirements and the operational speed of the passenger conveyor during installation or maintenance operations thereof can be variously adjusted in accordance with such operations.

Figure 6:
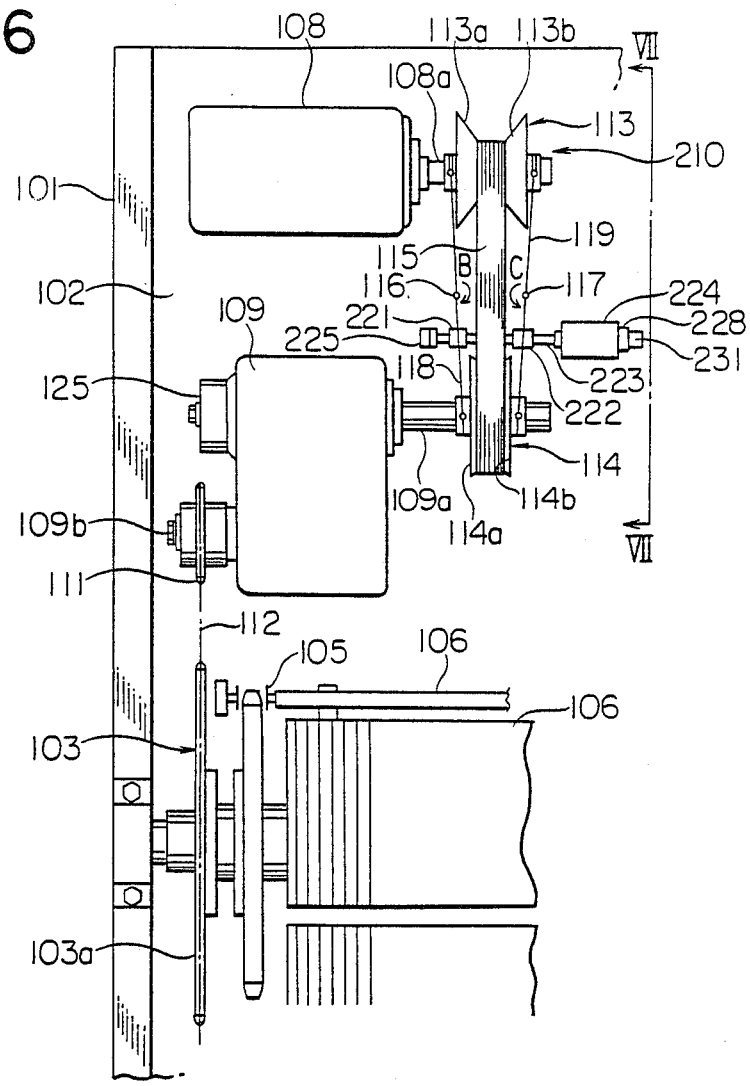
FIG. 6 is an enlarged plan view of an apparatus for driving a passenger conveyor in a second embodiment of the present invention.
Figure 7:
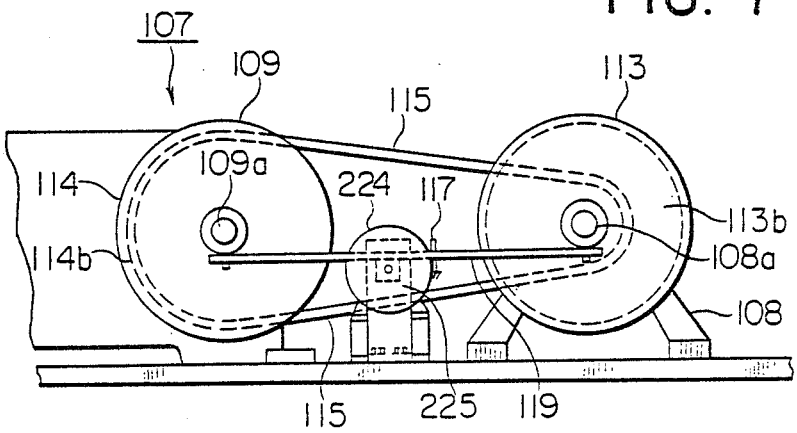
FIG. 7 is a side view of the apparatus for driving the passenger conveyor taken along Line VII—VII of FIG. 6.

FIGS. 6 to 10 show a second embodiment of the present invention. In this embodiment, a stepless change gear 210 comprises a pair of ball nuts 221 and 222 secured to first and second links 118 and 119, a feed screw 223 screwed into the ball nuts 221 and 222 and supported by a bracket 225 at one end of the feed screw 223, and a servo-motor 224 for speed change connected to the other end of the feed screw 223, those components being different from the ball nuts 120, 121, the brackets 122, the feed screw 123 and the handle 124 in the first embodiment shown in FIGS. 4 and 5. A pulse generator 228 is attached to the servo-motor 224 and detects the feed quantity of the feed screw 223 by the rotation of the servo-motor 224. A tachometer generator 231 is attached to the servo-motor 224 and detects the voltage in proportion to the rotational speed of the servo-motor 224. The pulse generator 228 and the tachometer generator 231 constitute a control device for changing the effective diameters of pulleys 113 and 114 in accordance with at least one instruction for slow starting, slow stoppage or slow speed change of the conveyor. The remaining construction in FIGS. 6 and 7 is similar to that in the first embodiment shown in FIGS. 3 to 5.

Figure 8:
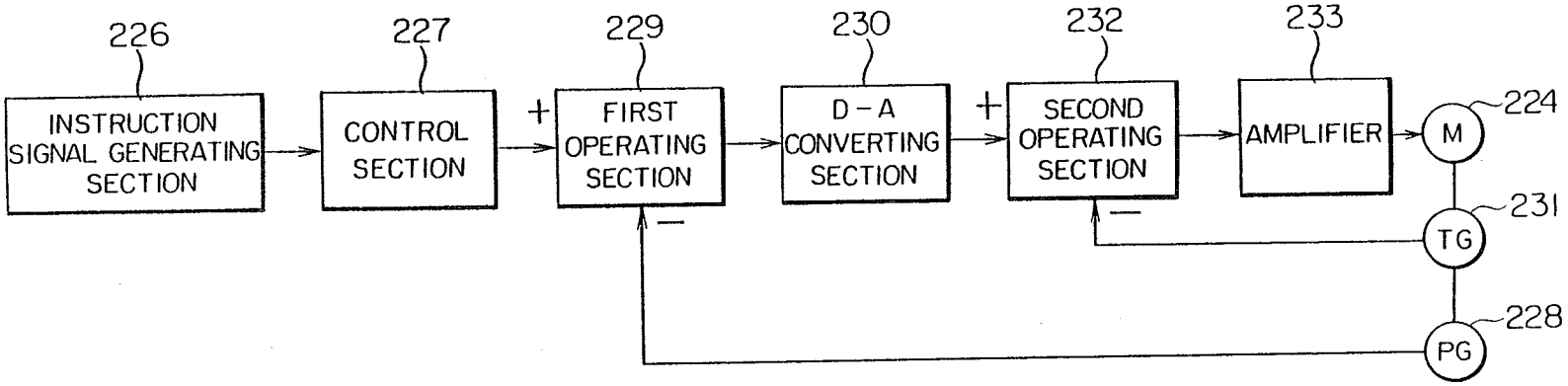
FIG. 8 is a block diagram of a control device for controlling the operational speed of the passenger conveyor in the second embodiment.

FIG. 8 shows a block diagram of the control device for controlling the servo-motor 224. The control device comprises an instruction signal generating section 226 generating an instruction signal for slow starting, slow stoppage and slow speed change of the passenger conveyor, and a control section 227 for controlling the number of pulses (corresponding to the feed quantity of the feed screw 223) in accordance with the instruction signal from the instruction signal generating section 226. The control device further comprises a first operating section 229 for operating the difference between the set number of pulses (feed quantity) from the control section 227 and the number of pulses from the pulse generator 228 detecting the feed quantity of the feed screw 223 by the rotation of the servo-motor 224, and outputting a set pulse frequency (feed speed of the feed screw 223) based on the difference, a D-A converting section 230 for converting the set pulse frequency from the first operating section 229 into a voltage in proportion to this set pulse frequency, a second operating section 232 for operating the difference between the output voltage, i.e., the feed speed set voltage from the D-A converting section 230 and an output voltage from the tachometer generator 231 detecting the voltage in proportion to the rotational speed of the servo-motor 224, and an amplifier 233 for amplifying the difference voltage from the second operating section 232 and outputting the amplified voltage to the servo-motor 224.

The first operating section 229 is constituted by a servo-amplifier for operating and amplifying the difference between the set number of pulses from the control section 227 and the number of pulses from the pulse generator 228. The second operating section 232 is constituted by a servo-amplifier for operating and amplifying the difference between the feed speed set voltage from the D-A converting section 230 and the output voltage from the tachometer generator 231. Such control is a well-known technique described as a "soft servo" in Table 8 of "Section 4.1 Servo-mechanism" in Chapter 4, Section 21 of "MECHANICAL ENGINEERING REVIEW" published by Japanese Mechanical Society in 1977, and therefore the detailed explanation thereof will be omitted in the following descriptions.

Figure 9:
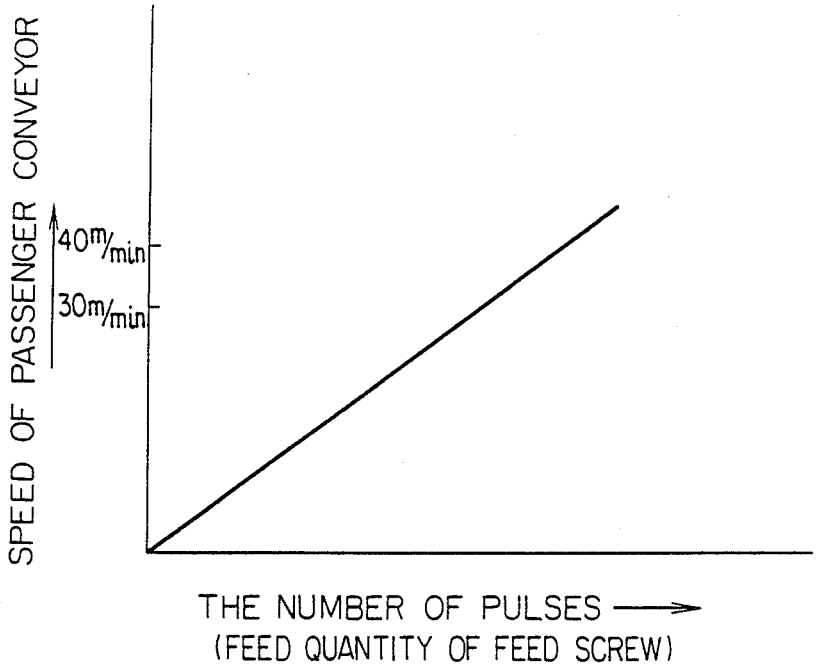
FIG. 9 is a graph showing the relation between the operational speed of the passenger conveyor and the number of pulses (corresponding to the feed quantity of a feed screw)
Figure 10:
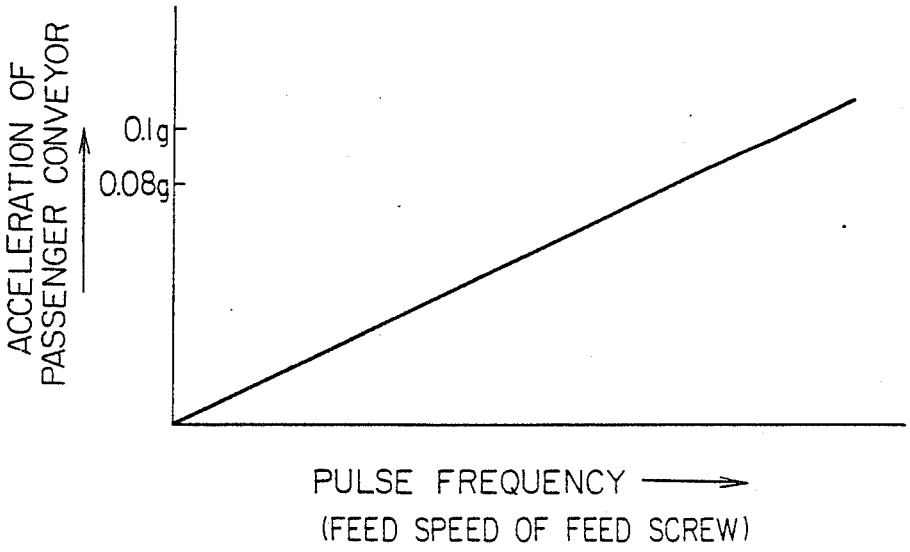
FIG. 10 is a graph showing the relation between the acceleration of the passenger conveyor and a pulse frequency (corresponding to the feed speed of the feed screw).

FIG. 9 is a graph of a characteristic curve showing the relation between the number of pulses (feed quantity of the feed screw) and the operational speed of the passenger conveyor in the second embodiment. FIG. 10 is a graph of a characteristic curve showing the relation between the pulse frequency (feed speed of the feed screw) and the acceleration of the passenger conveyor in the second embodiment.

The operation of the apparatus for driving a passenger conveyor according to the second embodiment will now be described.

When the passenger conveyor is slowly started, the operation of the driving apparatus is as follows.

First, in order to start the conveyor at the low operational speed, the effective diameters of the V-pulleys 113 and 114 of the electric motor 108 and the reduction gear 109 are respectively set to be 100 mm and 720 mm for example and therefore the speed change ratio is 1:7.2. When the electric motor 108 is started in this state, the rotation of the motor 108 is transmitted to the reduction gear 109 in accordance with the speed change ratio. Thus, the passenger conveyor is started for example at a low operational speed of 7.5 m/min through the chain 112, the upper chain gearing device 103, etc.

On the other hand, an instruction signal for slow starting is transmitted from the instruction signal generating section 226 to the control section 227 by the starting of the passenger conveyor. The control section 227 output a pulse for speed change gradually increasing the frequency thereof in accordance with time to the first operating section 229 so as to change from the low speed operation of the passenger conveyor at the starting thereof to normal speed operation. The number of pulses and the pulse frequency are controlled according to the characteristic curves of FIGS. 9 and 10.

The total number of pulses sets the feed quantity of the feed screw 223, i.e., the maximum operational speed of the passenger conveyor. When the pulse frequency is increased, the feed speed of the feed screw 223 increases, that is, the operational speed of the passenger conveyor is linearly increased with constant acceleration.

When the instruction signal corresponding to slow starting is transmitted from the control section 227 through the first operating section 229, the D-A converting section 230, the second operating section 232 and the amplifier 233 to the servo-motor 224 as described before, the servo-motor 224 is rotated in accordance with the instruction value and the feed screw 223 is thereby rotated in the clockwise direction in FIG. 7. Thus, the ball nuts 221 and 222 are moved such that they are separated from each other, thereby rotating the first and second links 118 and 119 around the pivot shafts 116 and 117 in the directions of arrows B and C of FIG. 6, respectively. Therefore, as described in the first embodiment, the effective diameters of the V-pulleys 113 and 114 of the electric motor 108 and the reduction gear 109 are respectively increased and decreased. The rotational speed of the reduction gear 109 is gradually increased in accordance with the change of both effective diameters, and thereby the operational speed of the passenger conveyor is gradually increased toward the normal operating speed thereof. When the operational speed of the passenger conveyor has reached a set speed of 30 m/min for example, the transmission of the pulse from the control section 227 is set to be stopped and the operation of the servo-motor 224 is set to be stopped. Thus, the passenger conveyor is operated at the constant operational speed (30 m/min) set by the effective diameters of the V-pulleys 113 and 114 related to the feed quantity of the feed screw 223. Thus, the passenger conveyor is slowly started from the starting speed of 7.5 m/min and increased to the normal speed of 30 m/min by the control of the speed change of the stepless change gear 210 in terms of the servo-motor 224.

In controlling the slow starting mentioned above, through the feed back of the pulse generated in proportion to the feed quantity of the feed screw 223 from the pulse generator 228 to the first operating section 229, the pulse is successively subtracted from the total number of pulses in the first operating section 229, thereby controlling the feed quantity of the feed screw 223 so as to be a set value. The voltage proportional to the feed speed of the feed screw 223 detected by the tachometer generator 231 is fed back to the second operating section 232, thereby controlling the servo-motor 224 such that the difference between the voltage from the tachometer generator 231 and a set voltage from the D-A converting section 230 is zero at any time.

Next, the case in which the passenger conveyor during operation is slowly stopped will be described.

When the operation of the passenger conveyor operated at a normal speed such as 30 m/min is slowly stopped, an instruction signal for the slow stoppage is transmitted from the instruction signal generating section 226 to the control section 227 and, in contrast to the slow starting mentioned above, a set pulse gradually decreasing the frequency thereof in proportion to time is output from the control section 227 to the first operating section 229. When an instruction signal corresponding to the set pulse is then transmited from the first operating section 229 through the D-A converting section 230, the second operating section 232 and the amplifier 233 to the servo-motor 224 as described before, the servo-motor 224 is driven to rotate the feed screw 223 in the counterclockwise direction in FIG. 7 in accordance with the instruction value. Thus, the ball nuts 221 and 222 approach each other and the first and second links 118 and 119 are respectively rotated around the pivot shafts 116 and 117 in the directions opposite the arrows B and C of FIG. 6. Accordingly, the effective diameters of the V-pulleys 113 and 114 of the electric motor 108 and the reduction gear 109 are respectively decreased and increased. In accordance with the change of the ratio of the effective diameters, the rotational speed of the reduction gear 109 is gradually decreased so that the operational speed of the passenger conveyor is gradually decreased from the normal speed. When the operational speed of the passenger conveyor has reached a low speed which facilitate stoppage such as 7.5 m/min, the pulse from the control section 227 is stopped and the operation of the servo-motor 224 is also stopped. Thereafter, when a stop signal is transmitted to the drive unit 107, the operation of the electric motor 108 is stopped, thereby slowly stopping the operation of the passenger conveyor.

When the operational speed of the passenger conveyor is changed, for example, from 30 m/min to 40 m/min or from 40 m/min to 30 m/min during the operation thereof, an instruction signal for the speed change is transmitted from the instruction signal generating section 226 to the control section 227 so that the number of pulses set in the control section 227 is changed in accordance with the instruction signal and the pulse frequency is increased or decreased corresponding to the increase or decrease of the operational speed of the conveyor, respectively, thereby changing the ratio of the effective diameters of the V-pulleys 113 and 114 of the electric motor 108 and the reduction gear 109 as described before. Thus, the slow speed change of the passenger conveyor is controlled and the passenger conveyor is smoothly operated at the instructed speed.

Accordingly, when the operational speed of the passenger conveyor is changed from 30 m/min to 40 m/min or from 40 m/min to 30 m/min for example, there is none of the shock at the time of the speed change in the passenger conveyor as there is in the conventional one and the speed change can be performed even when the passengers are being conveyed.

In the second embodiment mentioned above, the stepless change gear 210 is not limited to the structure shown in FIGS. 6 and 7. For example, another known structure may be substituted for the structure of the V-pulleys 113 and 114 and the link mechanism for operating the pulleys and the servo-motor 224 may be substituted for a pulse motor. Furthermore, the effects of the present invention can be obtained even when only one of the effective diameters of the V-pulleys 113 and 114 is variable.

As mentioned above, according to the second embodiment, the rotary shaft of an electric motor is connected to an input shaft of a reduction gear through a stepless change gear having pulleys attached to their shafts, and at least one of the effective diameters of the pulleys is variable and controlled by a control means for performing slow starting, slow stoppage and slow speed change of the passenger conveyor. Accordingly, the slow starting, the slow stoppage and the slow speed change of the passenger conveyor can be performed with a cheap means, the stepless operational speed of the conveyor can also be controlled simply and smoothly, and the space for the apparatus for driving the passenger conveyor can be reduced.

What is claimed is:

1. An apparatus which drives a passenger conveyor including a plurality of steps connected to each other and movable by a step chain, said driving apparatus comprising:

a motor driving a rotary output shaft;

a reduction gear having a rotary input shaft and a rotary output shaft;

a chain-gearing device operatively connected to said rotary output shaft of said reduction gear to drive the step chain;

a stepless change gear connecting said rotary output shaft of said motor to said rotary input shaft of said reduction gear to change relative rotational speeds of said motor and said reduction gear, said stepless change gear comprising a pair of pulleys having variable effective diameters and respectively attached to said rotary output shaft of said motor and said rotary input shaft of said reduction gear, said stepless change gear providing a slow unloaded-condition conveyor speed when said pulleys are in a first arrangement of effective diameters, a normal loaded-condition passenger conveyor speed substantially greater than the slow speed when said pulleys are in a second arrangement of effective diameters, and stepless change between the slow and normal speeds for the purpose of avoiding shock to the passengers on the conveyor when speed change is performed; and a control means for varying the effective diameters of said pairs of pulleys in accordance with instructions to provide the slow speed, the normal speed, and the speed change of the passenger conveyor and for starting and stopping the operation of said motor.

2. Apparatus for driving a passenger conveyor as claimed in claim 1 wherein said stepless change gear is of a belt driven type and comprises a first pulley having a variable effective diameter attached to the rotary shaft of the motor, a second pulley having a variable effective diameter attached to the input shaft of the reduction gear, a belt wound around both the first and second pulleys, and an adjusting means for changing the relative effective diameters of the first and second pulleys between a slow speed and a normal speed at least about five times greater than the slow speed.

3. Apparatus for driving a passenger conveyor as claimed in claim 2 wherein each of the first and second pulleys comprises a pair of circular truncated conical members opposing each other to form a generally V-shaped groove therebetween, said pair of circular truncated conical members respectively being slidably attached to each of the rotary shaft of the motor and the input shaft of the reduction gear in the axial directions thereof to change the effective diameters of the first and second pulleys engaging with the belt, said adjusting means comprising a pair of adjusting shafts for respectively joining said circular truncated conical members of the first pulley to said circular truncated conical members of the second pulley, said pair of adjusting shafts being pivotally secured to a frame of the apparatus between the first and second pulleys such that said pair of adjusting shafts are rotated in opposite directions to bring the circular truncated conical members of the first pulley towards each other and to simultaneously separate the circular truncated conical members of the second pulley from each other and such that said pair of adjusting shafts are rotated in opposite directions to separate the circular truncated conical members of the first pulley from each other and to simultaneously bring the circular truncated conical members of the second pulley towards each other.

4. Apparatus for driving a passenger conveyor as claimed in claim 3 wherein said adjusting means further comprises a pair of nut members respectively secured to said pair of adjusting shafts to rotate the adjusting shafts in opposite directions, and a feed screw member screwed into these nut members such that the nut members approach each other by rotating the feed screw member in one direction and are separated from each other by rotating the feed screw member in another direction.

5. Apparatus for driving a passenger conveyor as claimed in claim 4 wherein said adjusting means further comprises a handle device, connected to the feed screw member, for rotating the feed screw member.

6. Apparatus for driving a passenger conveyor as claimed in claim 2 wherein the effective diameters of both of the pulleys are variable and said stepless change gear further comprises a belt wound around both pulleys, link members for relatively changing the effective diameters of both pulleys, a feed screw for rotating said link members to change the effective diameters of the pulleys, and a servo-motor for rotating the feed screw in accordance with the instruction for slow starting, slow stoppage or slow speed change.

7. Apparatus for driving a passenger conveyor as claimed in claim 6, wherein said control means controls the number of pulses and pulse frequency therein in accordance with the slow start, the slow stop or the slow speed change of the passenger conveyor.

8. Apparatus for driving a passenger conveyor as claimed in claim 6 wherein said control means comprises:

an instruction signal generating section generating an instruction signal for slow starting, slow stoppage or slow speed change;

a control section outputting instructions for the amount of rotation and the speed of rotation of the servo-motor in accordance with the instruction signal from the instruction signal generating section;

a first operating section for calculating the difference between the amount of rotation output from the control section and a feed quantity output from a detector for detecting the feed quantity of the feed screw caused by the rotation of the servo-motor, said first operating section outputting a set instruction value corresponding to the rotational speed of the servo-motor based on said difference; and a second operating section for calculating the difference between the set instruction value from the first operating section and an output from a detector for detecting the rotational speed of the servo-motor, the servo-motor being driven on the basis of the output from the second operating section.

9. Apparatus for driving a passenger conveyor as claimed in claim 6 wherein said control means comprises:

an instruction signal generating section generating an instruction signal for slow starting, slow stoppage or slow speed change;

a control section outputting instructions for the amount of rotation and the rotational speed of the servo-motor in accordance with the instruction signal from the instruction signal generating section;

a first operating section for calculating the difference between the amount of rotation output from the control section and a feed quantity output from a detector for detecting the feed quantity of the feed screw caused by the rotation of the servo-motor, said first operating section outputting a set instruction value corresponding to the rotational speed of the servo-motor based on said difference;

a converting section for converting the set instruction value from the first operating section to a voltage corresponding to said set instruction value;

a second operating section for calculating the difference between the output voltage from the converting section and an output voltage from a detector for detecting the voltage corresponding to the rotational speed of the servo-motor; and an amplifier for amplifying the voltage difference from the second operating section, said servo-motor being driven on the basis of the output from the amplifier.

10. An apparatus as set forth in claim 1 wherein said stepless change gear includes a feed screw member disposed intermediate said rotary output shaft of the motor and said rotary input shaft of said reduction gear for changing the relative rotational speeds of said rotary input and output shafts.

11. An apparatus as claimed in claim 1 wherein said stepless change gear comprises:

a first pair of circular truncated conical members axially slideable on said rotary input shaft opposing each other to form a generally V-shaped groove therebetween;

a second pair of circular truncated conical members axially slideable on said rotary output shaft opposing each other to form a generally V-shaped groove therebetween;

an endless belt substantially similar in shape to that of said V-shaped grooves so as to connect the two pairs of circular truncated conical members such that said rotary input shaft is driven by said rotary output shaft;

link members connected at respective ends thereof and joining the two pairs of circular truncated conical members, said link members having pivots disposed between the axes of the rotary input shaft and rotary output shaft and intermediate the respective ends of said link members and being rotatable about the pivots to relatively change the widths of said v-shaped grooves; and separating means disposed between the axes of said rotary input shaft and rotary output shaft for rotating said link members about said pivots so as to adjust the relative widths of said V-shaped grooves, thereby steplessly changing the relative rotational speeds of the rotary input shaft and rotary output shaft, said separating means comprising:

a feed screw;

a pair of ball nuts axially disposed upon said feed screw and threadedly manipulated thereby, said ball nuts being connected to said link members intermediate the ends thereof and at a point spaced from said pivots and being movable along said feed screw responsive to rotations of said feed screw to rotate said link members about said pivots; and a control means axially connected to an end of said feed screw for rotation thereof.

12. An apparatus as claimed in claim 11 wherein said control means comprises a handle rotatable in one direction to increase the relative widths of said V-shaped grooves of said first pair of said circular truncated conical members and in an opposite direction to increase the relative widths of said V-shaped grooves of said second pair of said circular truncated conical members.

13. An apparatus as claimed in claim 1 wherein said control means further comprises:

a servo-motor rotating a feed member connected to vary the effective diameters of said pulleys in accordance with an instruction signal;

a detector detecting rotational speed of said servo-motor and generating an output voltage corresponding thereto;

an instruction signal generating section generating an instruction signal for flow starting, slow stoppage or slow feed change;

a control section outputting instructions for the amount of rotation and the rotational speed of the servo-motor in accordance with the instruction signal from the instruction signal generating section;

a first operating section calculating the difference between the amount of rotation output from the control section and a feed quantity output from a detector which detects feed quantity of said feed member caused by the rotation of the servo-motor, said first operating section outputting a set instructional value corresponding to the rotational speed of the servo-motor base on said difference;

a converting section converting the set instruction value from said first operating section to a voltage corresponding thereto;

a second operating section calculating the difference between the output voltage converted by said converting section and the output voltage generated by said detector; and an amplifier amplifying the voltage difference calculated from said second operating section, said servo-motor being driven on the basis of the output from the amplifier.

14. An apparatus as claimed in claim 11 wherein said link members comprise a pair of substantially cylindrical shafts pivotally connected to said circular truncated conical members for relatively changing the effective diameters thereof.

15. An apparatus as claimed in claim 11 wherein said pivots, through which said link members pass, are mounted between said rotary input shaft and said rotary output shaft, such that said link members pivot in opposite directions to bring the circular truncated conical members mounted on one rotary shaft closer to each other and to separate the circular truncated conical members mounted on the opposite rotary shaft.

* * * * *